US012180880B2

(12) United States Patent
Takada et al.

(10) Patent No.: US 12,180,880 B2
(45) Date of Patent: Dec. 31, 2024

(54) MARINE PROPULSION DEVICE

(71) Applicant: HONDA MOTOR CO., LTD., Tokyo (JP)

(72) Inventors: Hideaki Takada, Saitama (JP); Yasumasa Tamura, Saitama (JP); Noriaki Tsutsumi, Saitama (JP); Koichi Otaguro, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 18/184,426

(22) Filed: Mar. 15, 2023

(65) Prior Publication Data

US 2024/0309797 A1 Sep. 19, 2024

(51) Int. Cl.

| | |
|---|---|
| ***F01P 7/16*** | (2006.01) |
| ***B63H 20/28*** | (2006.01) |
| ***F01P 3/20*** | (2006.01) |
| *F01P 7/14* | (2006.01) |

(52) U.S. Cl.

CPC ..... *F01P 7/16* (2013.01); *B63H 20/28* (2013.01); *F01P 3/202* (2013.01); *F01P 2007/146* (2013.01)

(58) Field of Classification Search

CPC ..... F01P 7/16; F01P 3/202; F01P 2007/146; B63H 20/28

USPC ..... 123/41.08

See application file for complete search history.

(56) References Cited

U.S. PATENT DOCUMENTS

2002/0020366 A1* 2/2002 Yasuda ..... F01P 7/16 123/41.74

2015/0114324 A1* 4/2015 Maekawa ..... G05D 23/022 123/41.08

FOREIGN PATENT DOCUMENTS

JP 2015086974 A 5/2015

* cited by examiner

*Primary Examiner* — Lindsay M Low
*Assistant Examiner* — Omar Morales
(74) *Attorney, Agent, or Firm* — ARMSTRONG TEASDALE LLP

(57) ABSTRACT

A marine propulsion device (12) has an internal combustion engine (10) which includes a cooling water passage (20, 22, 32, 40) provided in an engine main body (14) of the internal combustion engine, a thermostat valve (34, 42) provided in the cooling water passage for opening and closing the cooling water passage according to a temperature of cooling water in the cooling water passage, and a cylindrical cooling water introduction member (96) surrounding the thermostat valves.

9 Claims, 8 Drawing Sheets

MARINE PROPULSION DEVICE

TECHNICAL FIELD

The present invention relates to a marine propulsion device, and in particular to a marine propulsion device having an internal combustion engine provided with an improved cooling system.

BACKGROUND ART

A water-cooled internal combustion engine is typically fitted with a thermostat valve that opens and closes a cooling water passage according to the temperature of the cooling water to maintain the engine temperature within a desired range for the optimum operation of the engine. The thermostat valve includes a housing typically made of a copper alloy while the engine main body is made of an aluminum alloy. Since copper and aluminum are far apart in the galvanic series, and aluminum has a greater tendency to undergo a galvanic reaction, an accelerated corrosion of the material of the engine main body surrounding the thermostat valve may be caused. This problem is particularly acute in internal combustion engines for marine propulsion devices which typically use the surrounding body of water including seawater for the cooling medium. Seawater is a highly electrolytic solution.

To overcome this problem, it was proposed in JP2015-86974A to enlarge the cross sectional area of the part of the cooling water passage where the thermostat valve is located so that the thermostat valve may be positioned far away from the inner wall of the cooling water passage.

However, when the cross sectional area of the cooling water passage near the thermostat valve is increased, a large temperature gradient may be created in the flow of the cooling water in a region immediate upstream of the thermostat valve. Therefore, the thermostat valve may be subjected to erratic changes in temperature with the result that the unstable operation of the thermostat valve such as hunting may be caused.

This has a negative impact on the durability of the thermostat valve, and may even impair the performance of the engine.

SUMMARY OF THE INVENTION

In view of such a problem of the prior art, a primary object of the present invention is to provide a marine propulsion device having an internal combustion engine provided with an improved cooling system in which galvanic corrosion of a part of the engine surrounding a thermostat valve thereof can be reduced in a favorable manner.

To overcome such a problem, a certain aspect of the present invention provides a marine propulsion device (12) having an internal combustion engine (10), the internal combustion engine comprising: a cooling water passage (20, 22, 32, 40) provided in an engine main body (14) of the internal combustion engine; a thermostat valve (34, 42) provided in the cooling water passage for opening and closing the cooling water passage according to a temperature of cooling water in the cooling water passage; and a cylindrical cooling water introduction member (96) surrounding the thermostat valves.

The cylindrical cooling water introduction member separates the thermostat valve from the surrounding wall surface of the cooling water passage so that the galvanic reaction between the thermostat valve and the surrounding wall surface can be minimized. Also, since the cooling water passage immediately upstream of the thermostat valve is not enlarged, the thermostat valve is prevented from hunting or otherwise behaving in an unstable manner.

Preferably, in this marine propulsion device, the cooling water introduction member is made of a material that has a higher ionization tendency (a greater tendency to undergo a galvanic reaction) than materials of the thermostat valve and the engine main body or is electrically insulating.

Thereby, progress of electrolytic corrosion of the engine main body is delayed, and the durability of the engine is improved.

Preferably, in this marine propulsion device, a cross-sectional area of a flow path defined between the cooling water introduction member and the thermostat valve is larger than an opening area of the thermostat valve when the valve is open.

Thereby, the cooling water is allowed to flow through the thermostat valve with an adequate flow rate, and an increase in pressure loss due to the cooling water introduction member can be avoided.

Preferably, in this marine propulsion device, the cooling water introduction member is provided with a tapered shape such that an inner diameter thereof progressively increases from an upstream side to a downstream side of the thermostat valve.

Thereby, a stable and smooth flow through the thermostat valve can be ensured. Furthermore, the process of mounting the cooling water introduction member can be facilitated.

Preferably, in this marine propulsion device, the cooling water introduction member extends further upstream than the thermostat valve.

Thereby, the inner wall of the cooling water passage surrounding the thermostat valve can be particularly favorably protected from galvanic corrosion.

Preferably, in this marine propulsion device, a part of the cooling water passage downstream of the thermostat valve is jointly defined by an outer surface (16A) of the engine main body having a first opening (32A) directly communicating with a part of the cooling water passage receiving the thermostat valve therein, and a second opening (38A) communicating with a part of the cooling water passage further downstream of the thermostat valve, a lid plate (51) attached to the outer surface of the engine main body and having a first hole and a second hole aligning with the first opening and the second opening, respectively, and a cover member (62) attached to the lid plate so as to define a communicating passage communicating the first opening with the second opening via the first hole and the second hole.

Thereby, the cooling water passage can be formed in such a manner that the assembling of the thermostat valve and the cooling water introduction member is facilitated. By forming the cooling water introduction member integrally with the lid plate, no gap is created between the two parts or there is no interface between the two parts. In particular, the cooling water that has passed along the thermostat valve is prevented from making a shortcut.

Preferably, in this marine propulsion device, the thermostat valve includes a body portion (76) defining a valve seat and provided with a radial flange (76A) in a downstream end part thereof, the radial flange being interposed between a shoulder surface (51A) of the lid plate and the cover plate.

Thereby, the cooling water passage can be formed in such a manner that the assembling of the thermostat valve and the cooling water introduction member is facilitated.

Preferably, in this marine propulsion device, the cooling water introduction member is integrally formed with the lid plate.

Thereby, the assembling of the cooling water passage can be facilitated.

Preferably, in this marine propulsion device, the cooling water introduction member is provided with a radial flange (96A) in a downstream end thereof, the radial flange being interposed between a shoulder surface (51A) of the lid plate and the radial flange of the thermostat valve.

Thereby, the assembling of the cooling water passage can be facilitated.

Preferably, in this marine propulsion device, the body part of the thermostat valve is made of plastic material, and the cooling water introduction member is integrally molded with the body part.

Thereby, the assembling of the cooling water passage can be facilitated.

Thus, the present invention provides a marine propulsion device having an internal combustion engine provided with an improved cooling system in which galvanic corrosion of a part of the engine surrounding a thermostat valve thereof can be prevented in a favorable.

DESCRIPTION OF THE PREFERRED EMBODIMENT(S)

A marine propulsion device (outboard motor) according to an embodiment of the present invention will be described in the following with reference to the appended drawings.

Figure 1:
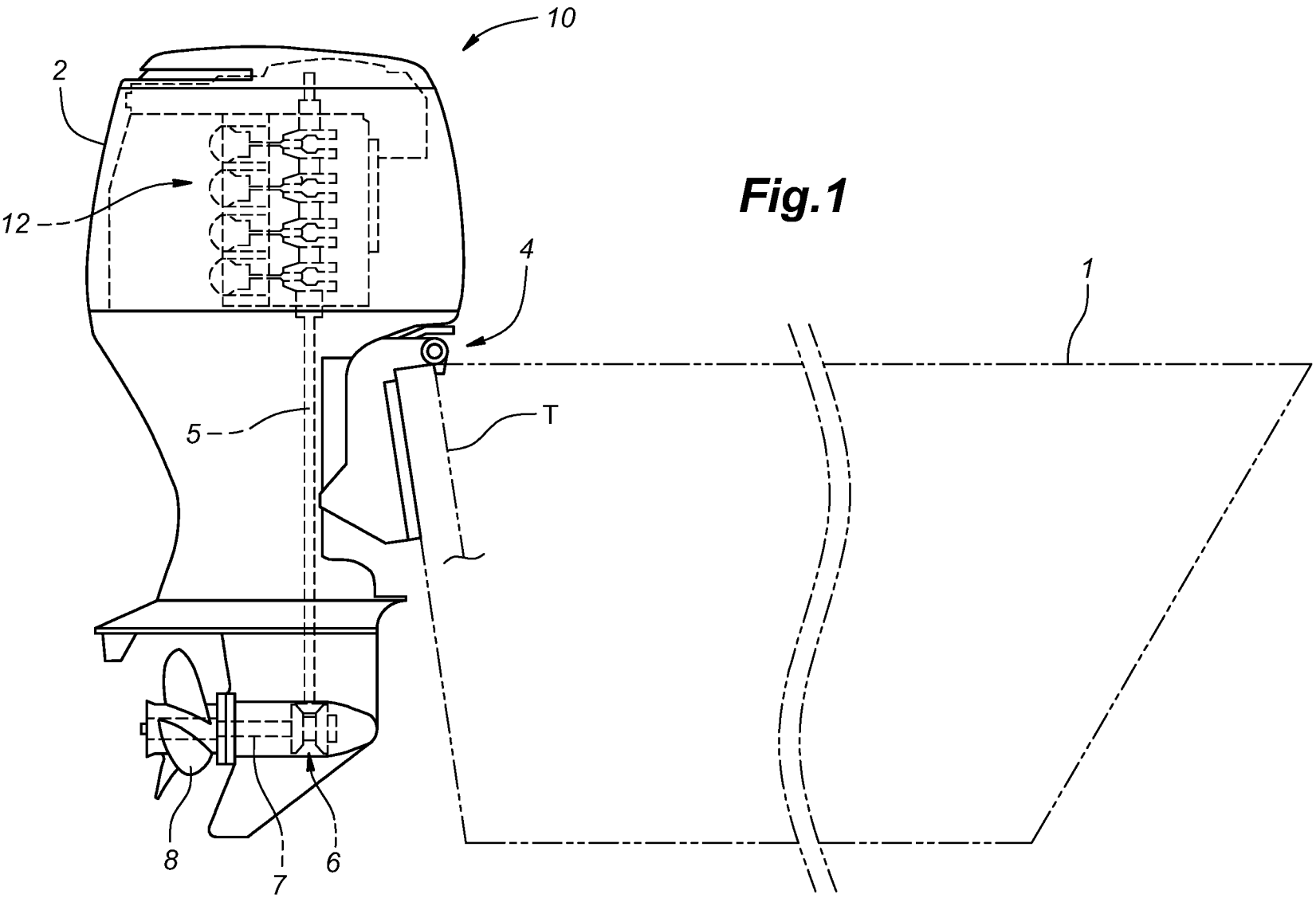
FIG. 1 is a side view of a marine propulsion device according to an embodiment of the present invention.

FIG. 1 shows a marine propulsion device 10 according to an embodiment of the present invention mounted on watercraft consisting of a boat 1. The marine propulsion device 10 is encased in a housing 2, and is mounted to the transom T of the boat 1 by using a per se known clamp mechanism 4. The clamp mechanism 4 allows the marine propulsion device 10 to be swung sideways, and tilted up and down in a per se known manner.

An internal combustion engine 12 having a vertical crankshaft is provided inside the housing 2. The output end of the crankshaft is connected to a drive shaft 5 that extends downward, and the lower end of the drive shaft 5 is connected to a gear mechanism 6 that transmits the power of the internal combustion engine 12 to a propeller shaft 7 that extends rearward from the gear mechanism 6. The rear end of the propeller shaft 7 is fitted with a propeller 8. The gear mechanism 6 not only transmits power from the drive shaft to the propeller shaft 7, but also allows the rotational direction of the propeller shaft 7 to be reversed via a shift mechanism not shown in the drawings.

Figure 2:
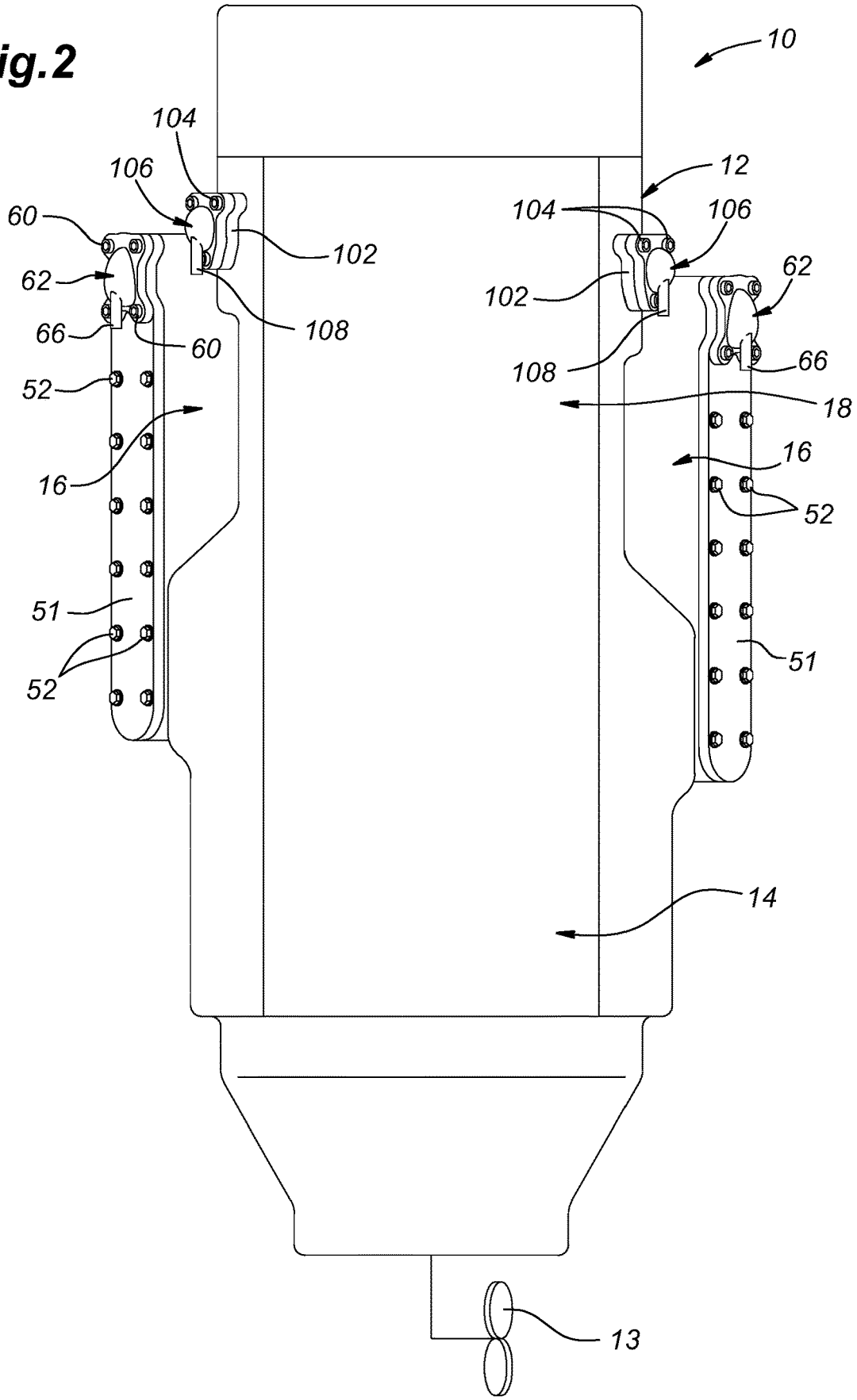
FIG. 2 is a front view of the marine propulsion device.

As shown in FIG. 2, the internal combustion engine 12 consists of a water-cooled V-8 engine having a pair of banks of cylinders, and a crankshaft extending vertically in normal use.

The internal combustion engine 12 includes an engine main body 14 made of metal such as aluminum alloy. The engine main body 14 includes a cylinder block 18 defining cylinder bores therein, and a pair of cylinder heads 16 (see FIG. 3) for the respective cylinder banks.

As shown in FIGS. 3 to 6, the cylinder head 16 of each cylinder bank is provided with a head-side cooling water passage 20 extending along either side of the corresponding cylinder row. The cylinder block 18 is provided with a bore-side cooling water passage 22 extending along either side of the cylinder row of each bank. The head-side cooling water passages 20 and the bore-side cooling water passages 22 both communicate with a cooling water supply passage 24 provided in a lower end part of the internal combustion engine 12.

The cooling water for this internal combustion engine 12 is drawn from the surrounding body of water. For this purpose, a pump 26 is provided in a cooling water inlet passage 30 connected to the lower end of the cooling water supply passage 24 at one end thereof, and having a water inlet 28 at the other end thereof. The water inlet 28 is submerged in the water under normal condition, and is fitted with a filter 29.

The cooling water supply passage 24 communicates with various parts of the internal combustion engine 12 which are required to be cooled, in addition to the head-side cooling water passages 20 and the bore-side cooling water passages 22.

The cylinder head 16 of each cylinder bank is provided with a head-side cooling water discharge passage 32 that communicates with an upper end of the corresponding head-side cooling water passage 20. The downstream end of the head-side cooling water discharge passage 32 opens at a flat surface 16A of the cylinder head 16, and defines an upper opening 32A. Another opening or a lower opening 38A is formed on this flat surface 16A of the cylinder head 16 immediately under the upper opening 32A. The lower opening 38A communicates with an outlet passage 38 which is defined mostly in the cylinder head 16. The downstream end of the outlet passage 38 communicates with a cooling water release passage 36 whose lower end is positioned so as to be submerged in the surrounding water.

A lid plate 51 made of plastic material is overlaid on the flat surface 16A of the cylinder head 16. The lid plate 51 is formed with a pair of holes 54 and 56 which are conformal to and aligned with the upper opening 32A and the lower opening 38A, respectively, and is attached to the flat surface 16A by using bolts 52. A cover member 62 is attached to the outer surface of the lid plate 51 by using bolts 60. The inner surface of the over member 62 is provided with a cavity 64 which encompasses both the upper hole 54 and the lower hole 56 of the lid plate 51 (the upper opening 32A and the lower opening 38A).

A lower end part of the cover member 62 is provided with a hose nipple 66 extending downward to define a drain passage 44 therein. The drain passage 44 is connected to a downstream part of the cooling water release passage 36 via a hose 48. To ensure water tight attachment of the lid plate 51 and the cover member 62, a first seal member 58 is provided on the lid plate 51 so as to surround the upper opening 32A and the lower opening 38A, and a second seal member 68 is provided on the cover member 62 so as to surround the upper hole 54 and the lower hole 56 of the lid plate 51.

Thus, a continuous passage extends from the head-side cooling water discharge passage 32 to the outlet passage 38 via the upper opening 32A and the lower opening 38A. the holes 54 and 56 in the lid plate 51, and the cavity 64 of the cover member 62.

The lid plate 51 is integrally formed with a cooling water introduction member 96 which is tubular in shape, and extends from the periphery of the upper hole 54 into the head-side cooling water discharge passage 32 via the upper opening 32A. The cooling water introduction member 96 has a substantially constant wall thickness, and is slightly tapered such that the upstream end is slightly smaller in diameter than the downstream end thereof, or the inner diameter thereof progressively increases from an upstream side to a downstream side of the thermostat valve 34.

The part of the outer surface of the lid plate 51 surrounding the upper hole 54 is recessed so as to form an annular shoulder surface 51A which is recessed from the outer surface of the lid plate 51. A thermostat valve 34 is positioned inside the cooling water introduction member 96. The thermostat valve 34 is provided with a valve housing 70. The valve housing 70 includes a disk-shaped body portion 76 centrally provided with an opening that defines a valve seat 74 (see FIG. 5). The disk-shaped body portion 76 of the thermostat valve 34 is provided with a radial flange 76A that rests upon the annular shoulder surface 51A of the lid plate 51. The cover member 62 is provided with a peripheral flange and a projection 62A projecting from the inner surface of the cover member 62 toward the lid plate 51. When the lid plate 51 and the cover member 62 are assembled to the engine main body, the peripheral flange and the projection 62A of the cover member 62 firmly press the radial flange 76A of the thermostat valve 34 against the annular shoulder surface 51A of the lid plate 51.

The part of the head-side cooling water discharge passage 32 immediately upstream thereof is provided with a bullet-shaped flow guide 98 which is attached to the wall of the head-side cooling water discharge passage 32 by three legs (not shown in the drawings). The flow guide 98 smooths the flow of water along the thermostat valve 34. The cover member 62 is provided with a stopper 62B projecting from the bottom wall of the cavity 64. The flow guide 98 additionally serves as a heat mass. In addition to reducing the flow resistance of the cooling water passage, the flow guide 98 warms the part of the cooling water that is about to flow into the thermostat valve 34 by the heat stored in the flow guide 98 so that the hunting of the thermostat valve 34 can be minimized.

The valve housing 70 further includes a frame portion 78 having a cage-like structure and extending into the head-side cooling water discharge passage 32 in the upstream direction inside the cooling water introduction member 96. The valve housing 70 is made of a copper alloy which has a less tendency to undergo a galvanic reaction than aluminum.

A bottom end (upstream end) of the frame portion 78 is closed, and contains therein a temperature sensing element 80 which includes an elastomeric diaphragm 84 and a thermo-wax 86 enclosed between the bottom end of the frame portion 78 and the diaphragm 84.

The thermostat valve 34 further includes a valve member 90 configured to cooperate with the valve seat 74, a valve stem 88 extending from the valve member 90 into the frame portion 78, a tubular spring retainer 92 surrounding and attached to the valve stem 88, and having a radial flange 92A at an end thereof remote from the valve member 90, and a compression coil spring 94 surrounding the valve stem 88 and the spring retainer 92, and interposed between an end of the frame portion 78 adjacent to the body portion 76 and the radial flange 92A of the spring retainer 92.

Figure 5:
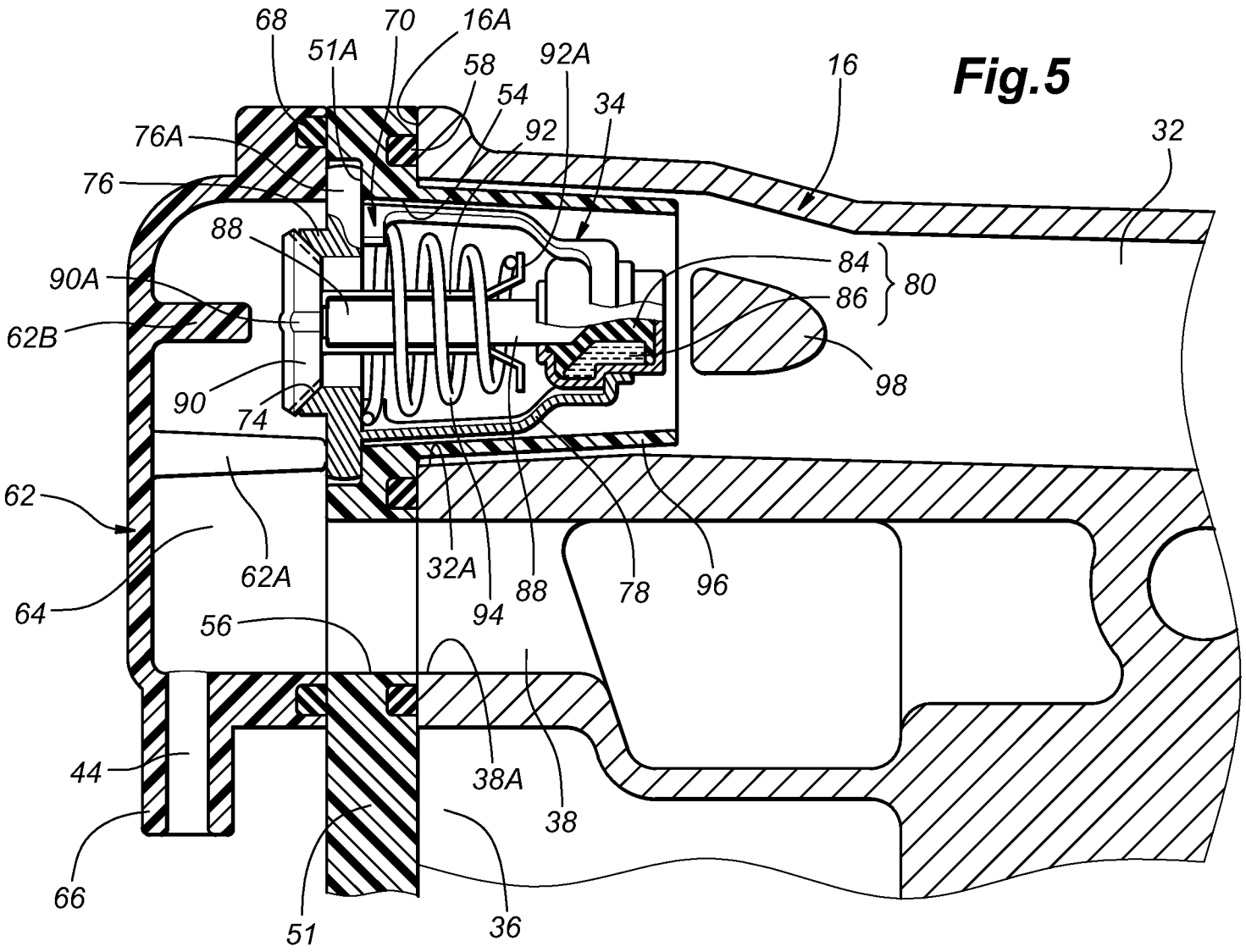
FIG. 5 is a fragmentary sectional view of a part of the internal combustion engine showing a thermostat valve thereof in closed state.
Figure 6:
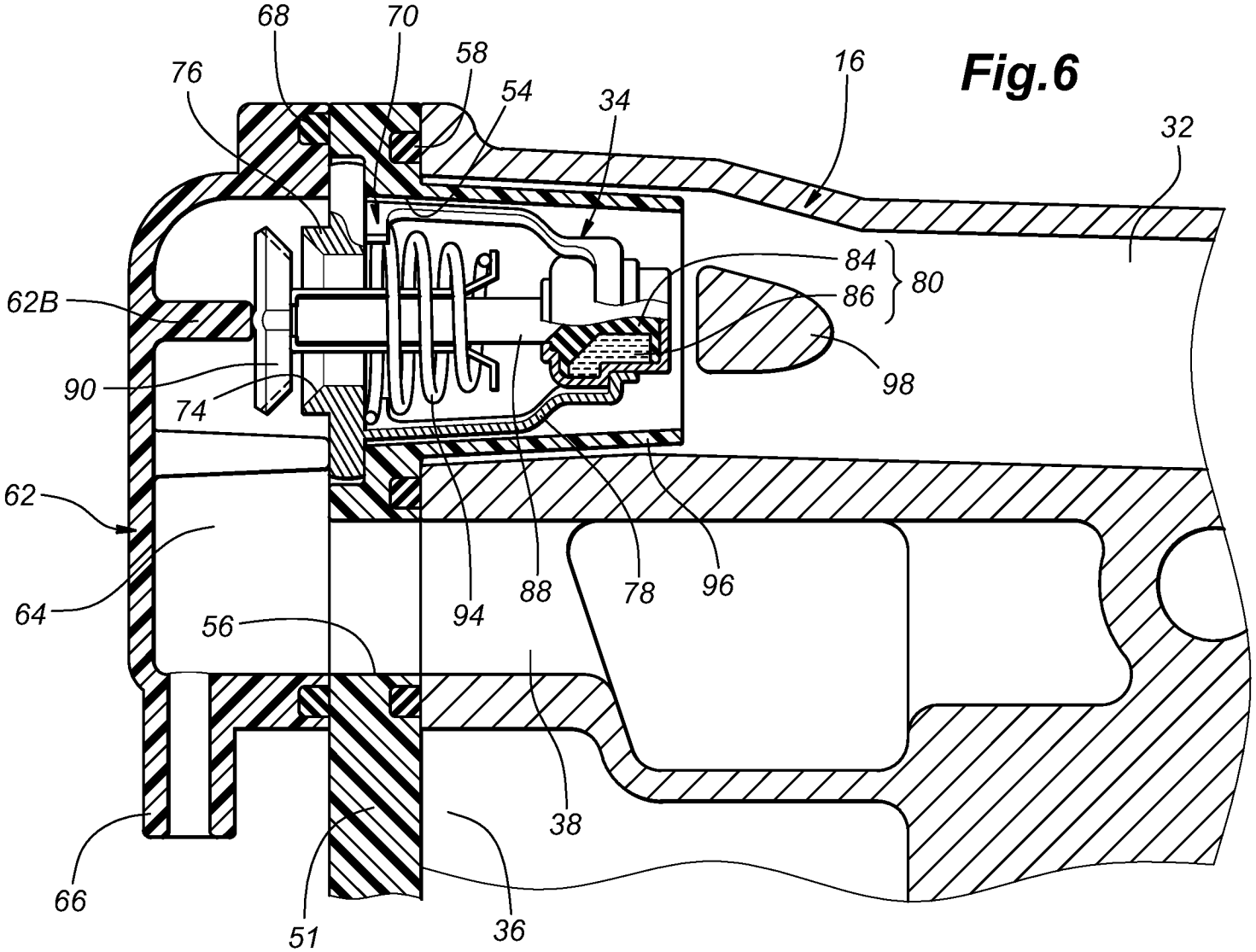
FIG. 6 is a view similar to FIG. 5 showing the thermostat valve in open state.

The thermo-wax 86 expands and contracts according to the temperature thereof in a reversible manner. When the temperature of the surrounding cooling water is low, the thermo-wax 86 is in the contracted state, and the valve member 90 closes the valve seat 74 under the spring force of the compression coil spring 94. As a result, the thermostat valve 34 essentially closes the flow of the cooling water. As shown in FIG. 5, the valve member 90 is provided with four recesses 90A to allow a small amount of cooling water to flow through even when the valve member 90 is in the closed state. When the temperature of the surrounding cooling water is high, the thermo-wax 86 is in the expanded state, and pushes the free end of the valve stem 88 in the direction to lift the valve member 90 away from the valve seat 74 against the spring force of the compression coil spring 94. The fully open position of the valve member 90 is determined by the abutting of the valve member 90 against the stopper 62B projecting from the inner surface of the cover member 62. As a result, the thermostat valve 34 freely allows the flow of the cooling water.

Preferably, the cross-sectional area of a flow path defined between the cooling water introduction member 96 and the thermostat valve 34 is larger than the opening area of the thermostat valve 34 when the valve is open. Thereby, the cooling water is allowed to flow through the thermostat valve 34 with an adequate flow rate, and an increase in pressure loss due to the cooling water introduction member 96 can be avoided.

The cylinder block 18 is provided with a bore-side cooling water discharge passage 40, for each cylinder bank, that communicates with an upper end of the corresponding bore-side cooling water passages 22. The downstream end of the bore-side cooling water discharge passage 40 opens at a flat surface of the cylinder block 18, and defines an upper opening 100. Another opening or a lower opening 101 is formed on this flat surface of the cylinder block 18 immediately under the upper opening 100. The lower opening 101 communicates with an outlet passage 39 which is defined mostly in the cylinder block 18. The downstream end of the outlet passage 39 is connected to the cooling water release passage 36.

A lid plate 102 made of plastic material is overlaid on the flat surface of the cylinder block 18. The lid plate 102 is formed with a pair of holes which are conformal to and aligned with the upper opening 100 and the lower opening 101, respectively. A cover member 106 is overlaid on the outer surface of the lid plate 102. The lid plate 102 and the cover member 106 are jointly attached to the cylinder block 18 by using bolts 104. The inner surface of the cover member 106 is provided with a cavity which encompasses both the upper opening 100 and the lower opening 101. Thus, a continuous passage extending from the bore-side cooling water passage 22 to the outlet passage 39 via the upper opening 100 and the lower opening 101 is defined by the lid plate 102 and the cover member 62.

The lid plate 102 is integrally formed with a cooling water introduction member (not shown in the drawing) which is similar to that of the lid plate 51. Another thermostat valve 42 is placed in the downstream end part of the bore-side cooling water discharge passage 40 surrounded by the cooling water introduction member. The mounting structure for the thermostat valve 42 is similar to that of the thermostat valve 34 for the head-side cooling water discharge passage 32.

A lower end part of the cover member 106 is provided with a hose nipple 108 extending downward to define a drain passage 46 therein. The drain passage 46 is connected to a downstream part of the cooling water release passage 36 via a hose 48. To ensure water tight attachment of the lid plate and the cover member, a first seal member is provided on the lid plate 102 so as to surround the upper opening 100 and the lower opening 101, and a second seal member is provided on the cover member 106 so as to surround the upper hole and the lower hole of the lid plate 102.

Since the structure, positioning and mode of operation of the thermostat valve 42 are similar to those of the thermostat valve 34 provided at the downstream end of the head-side cooling water discharge passage 32, the description related to this thermostat valve 42 is omitted from this disclosure.

Figure 3:
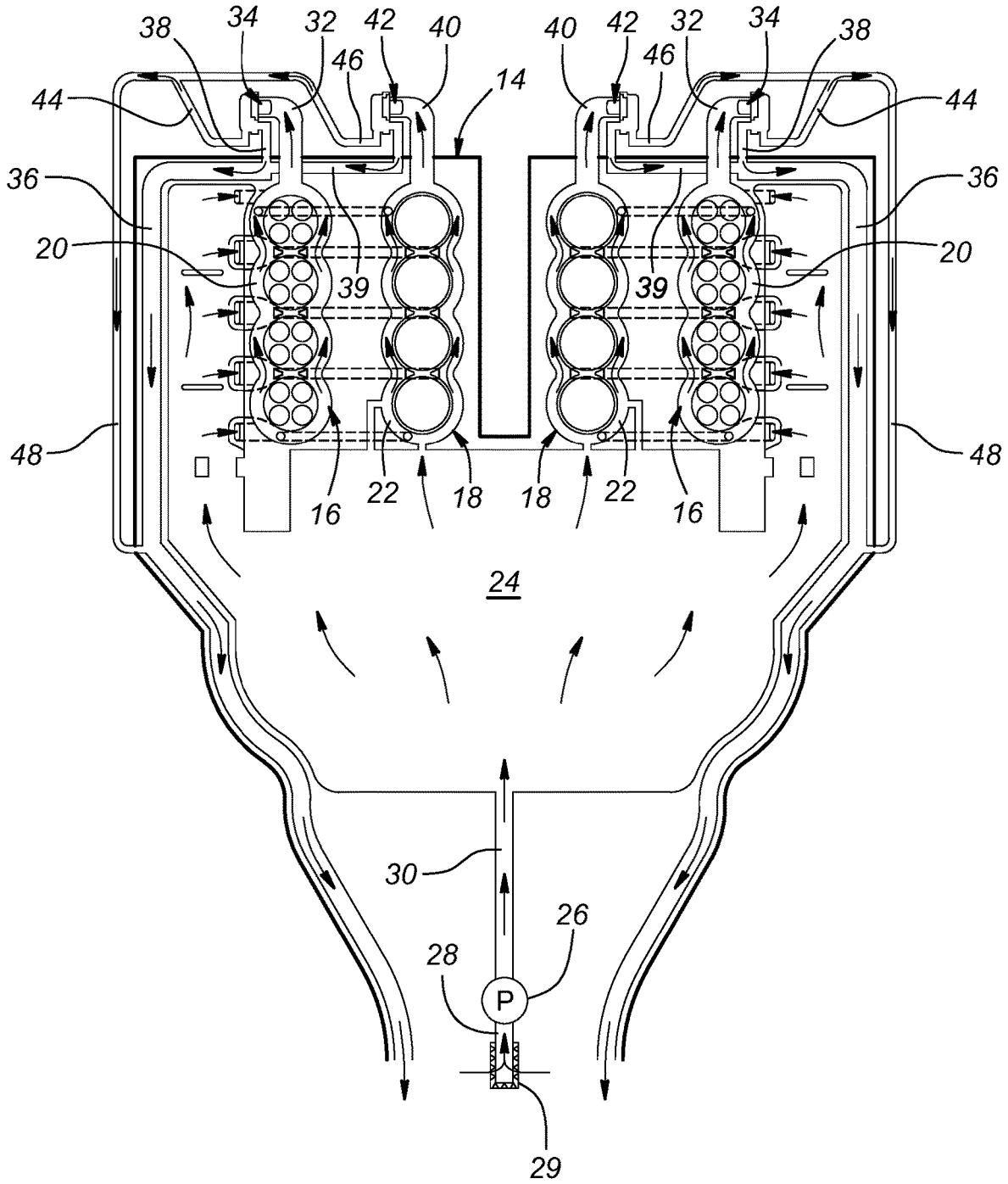
FIG. 3 is a schematic diagram showing a cooling system of the internal combustion engine of the marine propulsion device.
Figure 4:
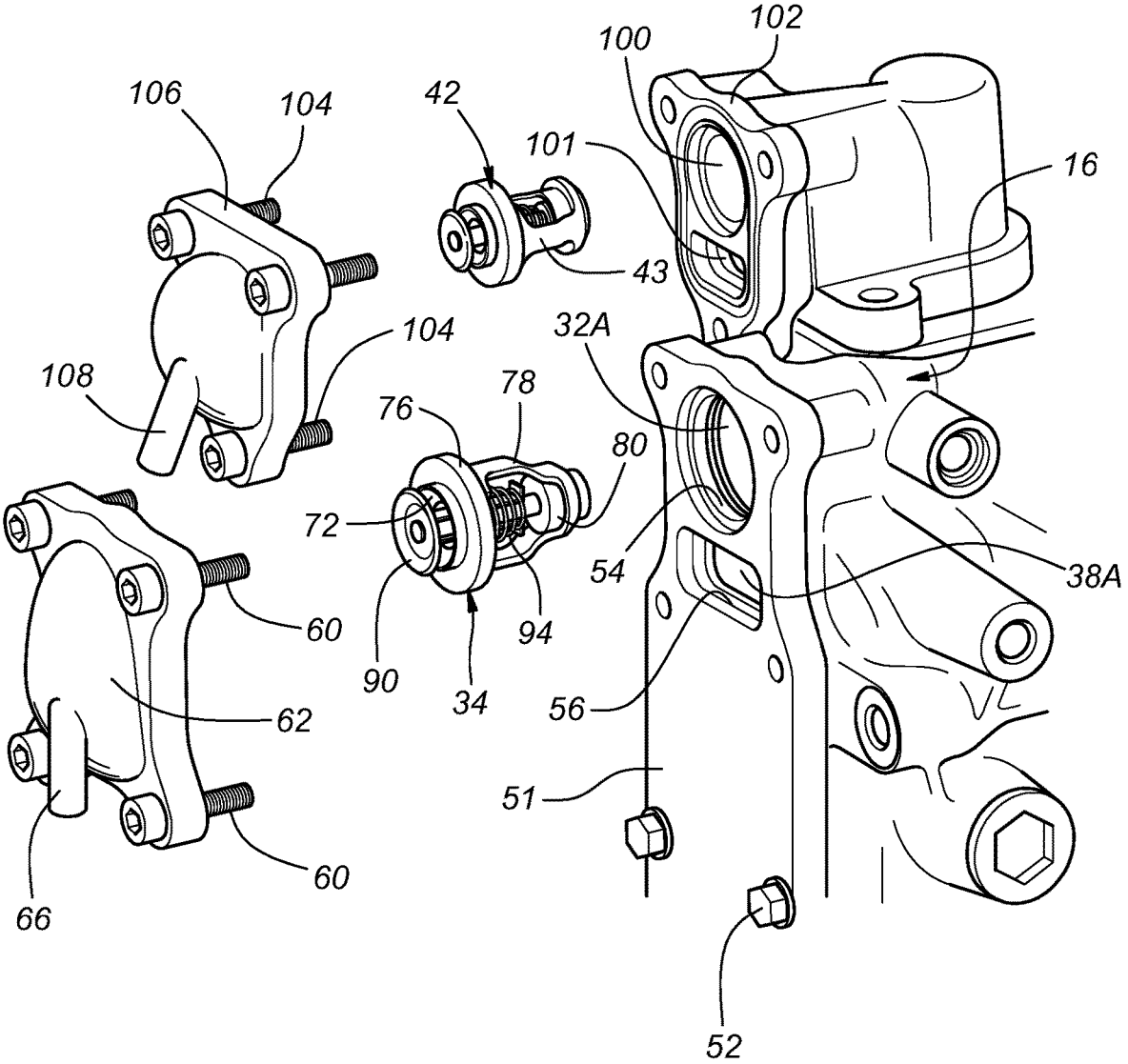
FIG. 4 is an exploded perspective view of part of the internal combustion engine.

The mode of operation of the cooling system described above will be described in the following with reference to FIG. 3.

The fresh water or seawater drawn by the cooling water pump 26 via the cooling water inlet 28 is filtered by the filter 29, and forwarded to the cooling water supply passage 24 via the cooling water inlet passage 30. The cooling water in the cooling water supply passage 24 is distributed to the left and right head-side cooling water passages 20 and to the left and right bore-side cooling water passages 22.

The cooling water flowing through each head-side cooling water passage 20 cools the head portion of corresponding cylinder bank, passes through the head-side cooling water discharge passage 32 and reaches the corresponding head-side thermostat valve 34. When the head-side thermostat valve 34 is open, the cooling water passes through the head-side thermostat valve 34 and flows through the outlet passage 38 to the cooling water release passage 36.

The cooling water flowing through each bore-side cooling water passage 22 cools the bore portion of the corresponding cylinder bank, passes through the bore-side cooling water discharge passage 40, and reaches the corresponding bore-side thermostat valve 42. When the bore-side thermostat valve 42 is open, the cooling water passes through the bore-side thermostat valve 42 and flows through the outlet passage 39 to the cooling water release passage 36.

The cooling water that has flowed into the cooling water release passage 36 is discharged from the lower end of the cooling water release passage 36 into the surrounding body of water. When the marine propulsion device 10 is tilted up with respect to the hull (not shown), the cooling water remaining in the head-side cooling water passages 20 and the bore-side cooling water passages 22 is drained to the cooling water release passage 36 via the thermostat valves 34 and 42, the drain passages 44 and 46, and the hoses 48.

In the illustrated embodiment, the cooling water introduction member 96 surrounds the outer periphery of the thermostat valve 34, and separates the thermostat valve 34 from the surrounding wall defining the head-side cooling water discharge passage 32. Thereby, migration of ions between the surrounding wall (cylinder head) and the thermostat valve 34, in particular the frame portion 78 thereof, is effectively prevented. As a result, the material of the surrounding wall which has a greater tendency to undergo a galvanic reaction than the frame portion 78 of the thermostat valve 34 is favorably protected from galvanic corrosion. In this regard, it is desirable that the upstream end of the cooling water introduction member 96 extends beyond the upstream end of the thermostat valve 34. Thereby, the cooling water that contains hydroxide ions dissolved from the material of the thermostat valve at a high concentration is more effectively restricted from migrating to the side of the cylinder head 16, with the result that a particularly high corrosion preventing result can be obtained.

Furthermore, the cooling water introduction member 96 prevents creation of spaces where cooling water may stagnate, and keeps the cooling water near the thermostat valve 34 to be concentrated in and around the thermostat valve 34. As a result, creation of excessive temperature gradients around the thermostat valve 34 is prevented, and this contributes to the stable operation of the thermostat valve 34 free from hunting.

According to the present embodiment, the cooling water introduction member 96 is integrally formed with the lid plate 51 so that the assembly process is simplified, and the number of component parts can be reduced. In particular, the installing of the cooling water introduction member 96 can be performed with an improved precision.

The cooling water introduction member 96 has a tapered shape that decreases in diameter from the downstream side to the upstream side of the head-side thermostat valve 34, thereby suppressing an increase in pressure loss and allowing stable control of the flow rate by the thermostat valve 34. In addition, the process of installing the cooling water introduction member 96 in the head-side cooling water discharge passage 32, and the process of installing the thermostat valve 34 into the cooling water introduction member 96 are both simplified.

The advantages mentioned above are equally applicable to the arrangement associated with the thermostat valve 42 provided at the downstream end of the bore-side cooling water discharge passage 40.

Figure 7:
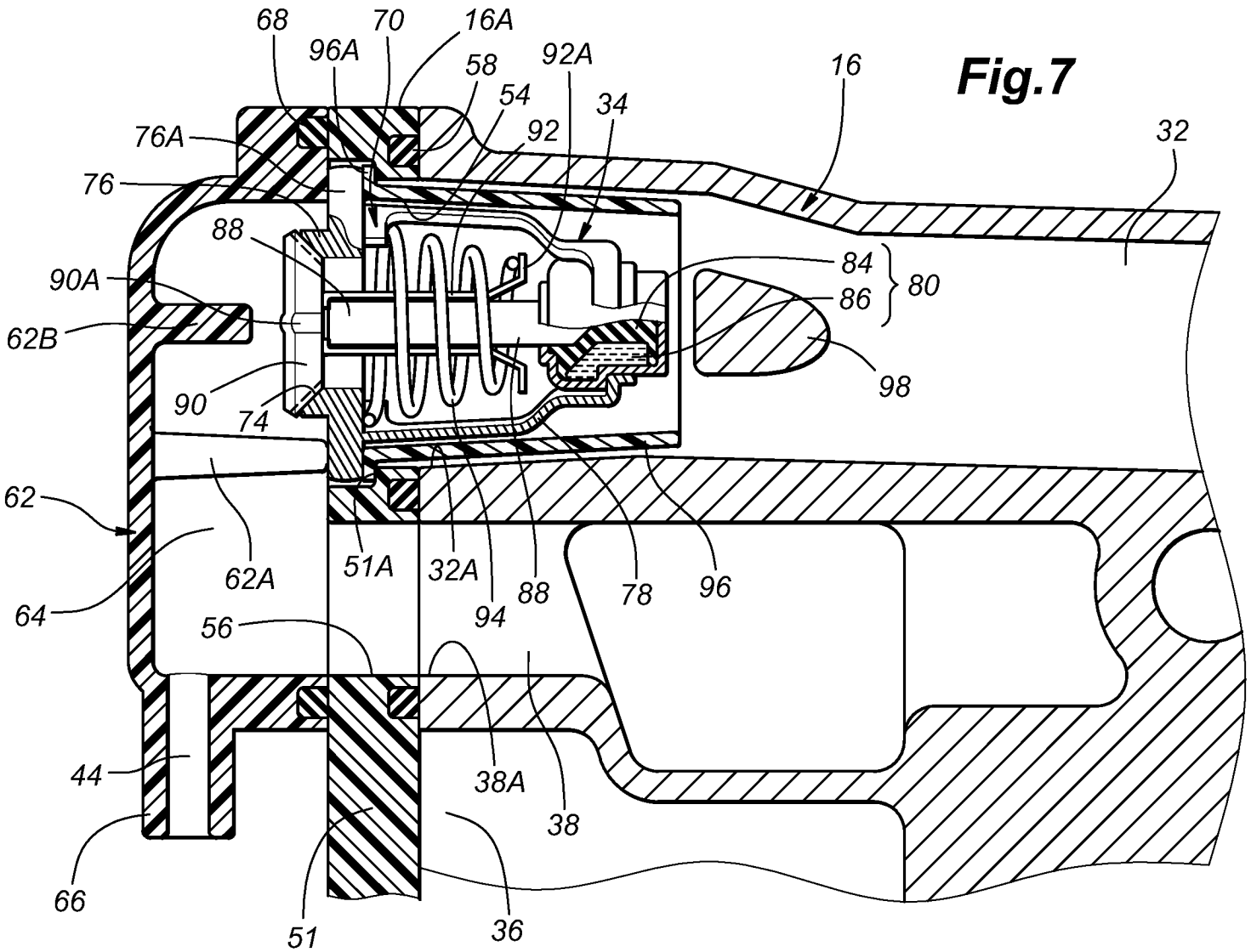
FIG. 7 is a view similar to FIG. 5 showing the configuration of the cooling water introduction member according to a modified embodiment of the present invention.

FIG. 7 shows a modified embodiment of the present invention. In this case, the cooling water introduction member 96 is made of a separate member, instead of being an integral part of the lid plate 51. The downstream end of the cooling water introduction member 96 is provided with a radial flange 96A which is interposed between the radial flange 76A of the thermostat valve 34 and the shoulder surface 51A. In this case also, the main part of the cooling water introduction member 96 consisting of a tubular member has a taper such that the diameter of the cooling water introduction member 96 progressively decreases toward the upstream side, and extends beyond the upstream end of the thermostat valve 34.

Since the lid plate 51 is simplified, and the cooling water introduction member 96 can be formed as a small component having a simple configuration, the manufacturing cost can be minimized, Since the cooling water introduction member 96 can be fixedly secured by interposing the radial flange 96A of the cooling water introduction member 96 between the lid plate 51 and the shoulder surface 51A, the assembling process can be simplified.

Figure 8:
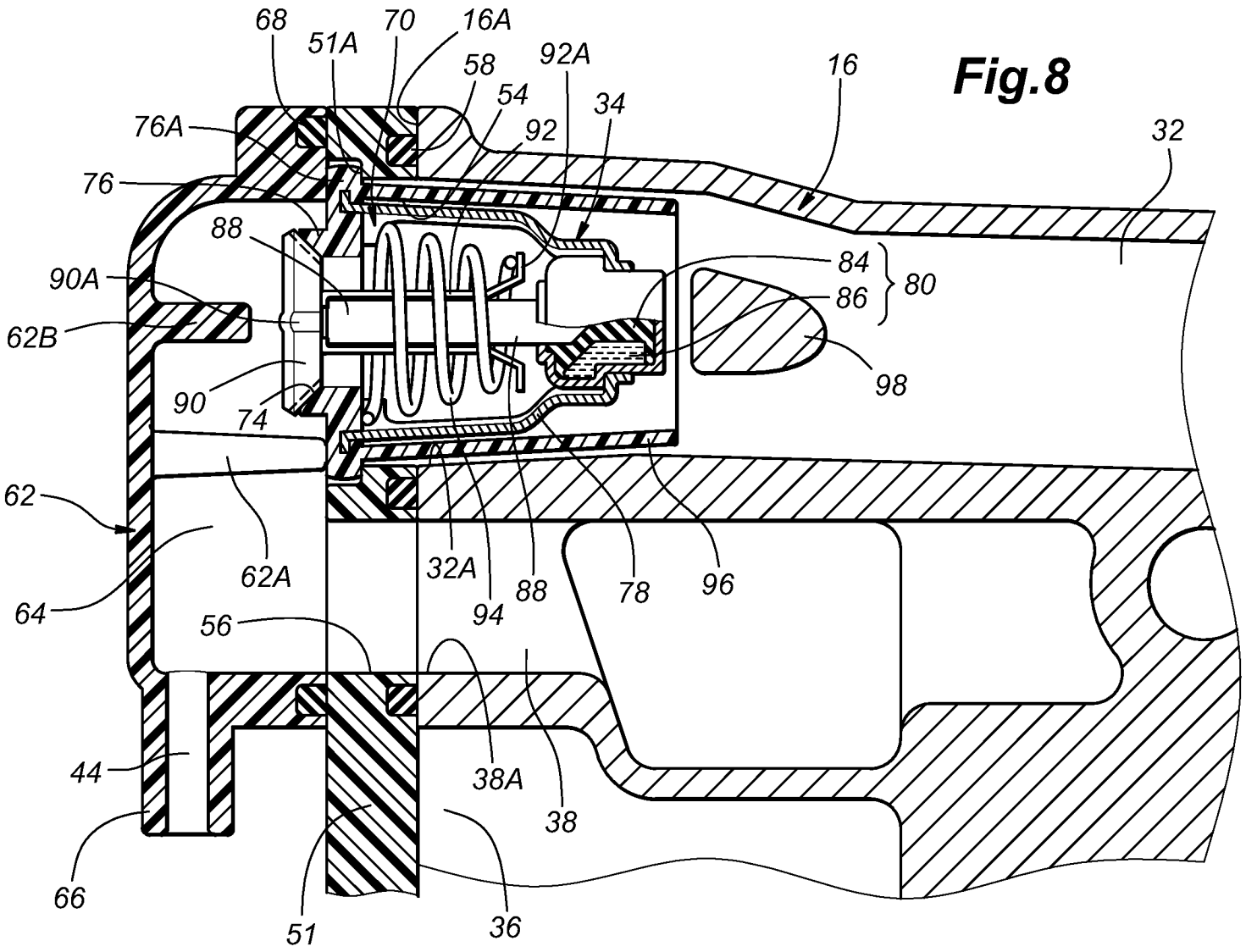
FIG. 8 is a view similar to FIG. 5 showing the configuration of the cooling water introduction member according to another modified embodiment of the present invention.

FIG. 8 shows another modified embodiment of the present invention. In this case, the disk-shaped body portion 76 of the thermostat valve 34 along with the radial flange 76A thereof is made of plastic material while the remaining part of the thermostat valve 34 is generally made of a copper based alloy. While the metallic part of the thermostat valve is insert molded with the disk-shaped body portion 76, the cooling water introduction member 96 is integrally molded with the disk-shaped body portion 76. In other words, the cooling water introduction member 96 is integrally formed with the thermostat valve 34.

Since the radial flange 76A extends radially beyond the outer circumference of the cooling water introduction member 96, the thermostat valve 34 can be fixedly secured by interposing the radial flange 76A between the lid plate 51 and the shoulder surface 51A. In this case also, the assembling process is simplified.

The present invention has been described in terms of specific embodiments thereof, but is not limited by such embodiments, and can be modified in various ways without departing from the scope of the present invention as can be readily appreciated by a person skilled in the art. For example, the cooling water introduction member 96 is not necessarily required to be integrally formed with the lid plate 51, and may also be a separate member from the lid plate 51. The cooling water introduction member 96 may also be made of other electrically insulating materials such as ceramic, or may be formed of a material having a higher ionization tendency (a greater tendency to undergo a galvanic reaction) than the material of the thermostat valve and the engine main body. Moreover, all of the components shown in the above embodiment are not necessarily essential, and can be appropriately substituted or omitted without departing from the spirit of the present invention. The contents of any cited references in this disclosure will be incorporated in the present application by reference.

The invention claimed is:

1. A marine propulsion device having an internal combustion engine, the internal combustion engine comprising:

a cooling water passage provided in an engine main body of the internal combustion engine;

a thermostat valve provided in the cooling water passage for opening and closing the cooling water passage according to a temperature of cooling water in the cooling water passage; and a cylindrical cooling water introduction member separately formed from the engine main body and provided in the cooling water passage so as to surround the thermostat and separate the thermostat valve from a surrounding wall defining the cooling water passage, wherein a part of the cooling water passage downstream of the thermostat valve is jointly defined by an outer surface of the engine main body having a first opening directly communicating with a part of the cooling water passage receiving the thermostat valve therein, and a second opening communicating with a part of the cooling water passage further downstream of the thermostat valve, a lid plate attached to the outer surface of the engine main body and having a first hole and a second hole aligning with the first opening and the second opening, respectively, and a cover member attached to the lid plate so as to define a communicating passage communicating the first opening with the second opening via the first hole and the second hole.

2. The marine propulsion device according to claim 1, wherein the cooling water introduction member is made of a material that has a greater tendency to undergo a galvanic reaction than materials of the thermostat valve and the engine main body or is electrically insulating.

3. The marine propulsion device according to claim 1, wherein a cross-sectional area of a flow path defined between the cooling water introduction member and the thermostat valve is larger than an opening area of the thermostat valve when the valve is open.

4. The marine propulsion device according to claim 1, wherein the cooling water introduction member is provided with a tapered shape such that an inner diameter thereof progressively increases from an upstream side to a downstream side of the thermostat valve.

5. The marine propulsion device according to claim 1, wherein the cooling water introduction member extends further upstream than the thermostat valve.

6. The marine propulsion device according to claim 1, wherein the thermostat valve includes a body portion defining a valve seat and provided with a radial flange in a downstream end part thereof, the radial flange being interposed between a shoulder surface of the lid plate and the cover plate.

7. The marine propulsion device according to claim 6, wherein the cooling water introduction member is integrally formed with the lid plate.

8. The marine propulsion device according to claim 6, wherein the cooling water introduction member is provided with a radial flange in a downstream end thereof, the radial flange being interposed between a shoulder surface of the lid plate and the radial flange of the thermostat valve.

9. The marine propulsion device according to claim 6, wherein the body part of the thermostat valve is made of plastic material, and the cooling water introduction member is integrally molded with the body part.

* * * * *